US008893331B2

(12) United States Patent
Cupo

(10) Patent No.: US 8,893,331 B2
(45) Date of Patent: Nov. 25, 2014

(54) MULTIPURPOSE ERGONOMIC ADJUSTABLE PILLOW WITH OFFSET CUTOUT

(76) Inventor: Elizabeth Cupo, Sarasota, FL (US)

( * ) Notice: Subject to any disclaimer, the term of this patent is extended or adjusted under 35 U.S.C. 154(b) by 0 days.

(21) Appl. No.: 12/890,068

(22) Filed: Sep. 24, 2010

(65) Prior Publication Data

US 2012/0073055 A1 Mar. 29, 2012

(51) Int. Cl.

| | |
|---|---|
| ***A47G 9/00*** | (2006.01) |
| ***A47G 9/10*** | (2006.01) |
| ***A47G 9/02*** | (2006.01) |
| ***A47C 7/38*** | (2006.01) |

(52) U.S. Cl.

CPC ..... *A47G 9/10* (2013.01); *A47G 9/0253* (2013.01); *A47C 7/38* (2013.01); *Y10S 5/951* (2013.01)

USPC ..... 5/636; 5/640; 5/644; 5/951

(58) Field of Classification Search

USPC ..... 5/636, 490, 640, 644

See application file for complete search history.

(56) References Cited

U.S. PATENT DOCUMENTS

| | | | | |
|---|---|---|---|---|
| 1,967,067 | A * | 7/1934 | Rightmire | 5/658 |
| 3,312,987 | A * | 4/1967 | Emery | 5/644 |
| 3,757,365 | A * | 9/1973 | Kretchmer | 5/636 |
| 3,911,512 | A * | 10/1975 | Plate | 5/652 |
| 5,339,472 | A * | 8/1994 | Yin | 5/636 |
| 5,864,904 | A | 2/1999 | Rudick | |
| 5,970,546 | A * | 10/1999 | Danis | 5/636 |
| 6,088,855 | A * | 7/2000 | Connolly | 5/636 |
| 6,532,611 | B1 * | 3/2003 | Day | 5/636 |
| 7,165,279 | B1 | 1/2007 | Georgescu | |
| D546,105 | S * | 7/2007 | McMillian | D6/601 |
| 7,322,061 | B2 | 1/2008 | Carroll | |

FOREIGN PATENT DOCUMENTS

JP 11262425 A * 9/1999

* cited by examiner

*Primary Examiner* — Brittany Wilson

(57) ABSTRACT

A multipurpose, ergonomic, adjustable head, neck, and face pillow for use in sleeping and resting positions, both supine and upright. The pillow includes a contoured pillowcase that is used to adjust for pillow firmness. The pillowcase has a hook-and-loop closure that is used to adjust the pillow's firmness and thickness. The contoured pillowcase can be made of materials including cotton, satin, water resistant fabric, etc. The pillow insert is generally rectangular in shape with a U-shaped offset cutout along one side that can be rotated to accommodate a variety of sleeping and resting positions. The pillow insert can be filled with an array of soft loose fill including polyester fill, down, down alternative, wool, etc.

5 Claims, 12 Drawing Sheets

MULTIPURPOSE ERGONOMIC ADJUSTABLE PILLOW WITH OFFSET CUTOUT

FIELD OF THE INVENTION

The invention relates to bedding and, more particularly, to a pillow having a U-shaped offset cutout for sleeping with adjustable sides and shapes allowing for optimal comfort of the user.

BACKGROUND OF THE INVENTION

Pillows are important for sleeping, resting, and for creating comfort. Ever since pillows were invented, there has been a need to have a pillow that is adjustable (in terms of fullness), and has utilities that support the head, neck, and face in a variety of supine, resting, and upright positions.

Currently, sleep pillows are designed for sleep in a supine position. They typically cannot be adjusted for fullness and are not suitable for all sleeping positions. Pillows with larger amounts of loft, for instance, are recommended (and labeled) for side sleeping, while pillows with lesser amounts of loft are recommended (and labeled) for stomach sleepers. There is a need for a single sleeping pillow that can be adjusted for fullness, and is suitable for all supine sleeping positions (side, back, and stomach).

Currently, pillows are designed for use in a supine position. However, these pillows are not comfortable when used in a reclining or upright position. They are often too large, too heavy, and do not stay in place. There is a need for a pillow that is adjustable in terms of fullness, and can be used comfortably in both supine and reclining/upright positions.

For those who sleep on their sides or on their stomach in a prone position, a traditional pillow is often uncomfortable. The nose is blocked, so one has to rotate one's head significantly to one side in order to breathe freely. This can lead to neck and shoulder discomfort. There is a need for a pillow that is adjustable for fullness, creates a clear pathway to the nose for breathing, keeps the head and neck in relative alignment, and provides optimal comfort for side and stomach sleepers.

It would be advantageous to provide comfort to side and stomach sleepers who can rotate a pillow cutout to the side. The soft arms created by a cutout can support the head and neck while the face remains suspended over the cutout.

Certain pillows are designed for individuals who sleep with a continuous positive airway passage (CPAP) type device for a condition known as sleep apnea. Typically, these pillows have a cutout to reduce face mask pressure and to create a clear pathway to the nose and mouth for easier breathing. However, these pillows are not adjustable for fullness. Furthermore, these prior art CPAP pillows are not suitable for reclining and upright positions. There is a need for a pillow that can be adjusted for fullness, is compatible with a CPAP type device, and can be used in both supine and reclining/upright positions.

Prior art beauty pillows are designed to reduce facial pressure following facial plastic surgery. Typically, these pillows have a centered cutout to reduce facial pressure. These pillows are not adjustable for fullness. They do not have an offset cutout that accommodates users with varying neck and shoulder sizes. Furthermore, they are not suitable for reclining or upright positions, positions that are often recommended following facial plastic surgery. There is a need for a pillow that can be adjusted for fullness, accommodates varying neck and shoulder sizes, and can be used in both supine and reclining/upright positions.

Many people enjoy having head and neck support while in a reclining or upright position. Currently, some pillows are designed to support the neck specifically. However, these pillows are not adjustable in terms of fullness, do not accommodate a variety of body types and, furthermore, do not support the head. A pillow is needed that is adjustable and supports the head and neck in reclining/upright positions.

Prior art pillows intended for sleeping and resting are not aesthetically decorative. In contrast, most decorative pillows are not practical for sleep and rest. There is a need for a pillow that is adjustable, versatile, can be used in a variety of sleeping and resting positions, and yet is also decorative. The present invention has an outer, contoured pillowcase available in a variety of fabrics to match home decor, making it aesthetically suitable for bedroom, family room, or living room.

Some pillows are not easily portable due to size. The standard sleep pillow is too large to carry on a plane or fit neatly into a small overnight suitcase. There is a need for a compact pillow that is portable, is adjustable in terms of fullness, and supports the head, neck, and face in a variety of supine, resting, and upright positions.

Some smaller portable pillows (i.e., neck pillows) do not have removable and washable pillowcases. The covers cannot be washed without washing the entire pillow. There is a need for a pillow that is portable, has a removable and washable pillowcase, and is versatile and adjustable to support the head, neck, and face in a variety of supine, resting, and upright positions.

U.S. Pat. No. 7,322,061, issued Jan. 29, 2008 to Carroll, for MULTIPURPOSE SUPPORT PILLOW discloses a multipurpose, apostrophe-shaped pillow used primarily for nursing mothers and prenatal support. The pillow itself cannot be adjusted for firmness. Furthermore, different sized embodiments are recommended to meet the different needs of its user. In addition, this pillow cannot support the head and neck simultaneously in a variety of supine and upright positions.

U.S. Pat. No. 5,864,904, issued Feb. 2, 1999 to Rudick, for BED PILLOW discloses a bed pillow made of two pillow covers, tethered by fabric. The principal object of the article is to provide a bed pillow that that can be used in a variety of sleep positions. This pillow is designed and pictured primarily for prone sleepers. While side sleeping would be possible with this pillow, it is unclear how one would sleep on one's side, have free air flow to the nose, and continue to have support for the neck. There is no cutout. Furthermore, there is no indication that this pillow can be adjusted for fullness without adding an additional pillow.

U.S. Pat. No. 7,165,279, issued Jan. 23, 2007 to Georgescu, for FACIAL PILLOW discloses a pillow to preserve a user's facial beauty. The upper and lower leg members on each side are angled relative to one another to form a V-shaped gap on either side. All four legs are of equal width and size. The user must strap the facial beauty pillow to a conventional pillow to adjust the resting height of the head according to the individual comfort level of the user. Furthermore, this pillow is intended for use in a supine position and cumbersome for use in upright/reclining positions.

U.S. Pat. No. D546,105, issued Jul. 10, 2007 to McMillian, for COMBINED ORTHODIC PILLOW AND COVER discloses a wedge shaped pillow. There is a decrease in the size of the outside edges of the pillow from back to front. Furthermore, the outside edges back to front are not parallel, resulting in the front edge being shorter than the back edge, measured from side to side. A U-shaped cutout is centered along the front edge of the pillow. The end view of the pillow is rectangular with four distinct surfaces, which are generally straight and perpendicular to each other. The pillow has a square-shaped cover that is symmetrical front and back and is not congruent with the shape of the pillow.

SUMMARY OF THE INVENTION

U.S. Pat. No. 4,738,488 issued in Apr. 19, 1988 to Camelio for ADJUSTABLE HEADREST discloses a device that can serve both as a headrest for fastening to the back of a chair or automobile seat or, in a folded over position, as an adjustable neck and headrest. Camelio comprises a U-shaped bolster pillow sewn/fastened to the curved edges of a flot fabric panel in the shape of a semi-ellipse. It also includes an elongated tab with Velcro or snaps that is used to attach the headrest to the back of the seat.

For the purposes of this disclosure, when referring to the Camelio device, the term headrest connotes specifically the headrest configuration and the term neck rest connotes specifically the neck rest configuration.

In the Camelio invention (neck rest configuration, FIG. 3*b*, 3*c*), the pillow is tightened by going through the U shape. This is different from the Cupo invention where the pillow case flap tightens from the top (side opposite the U-shaped cutout) and goes around the back of the pillow without going through the U-shaped cutout. According to the Camelio patent, "FIGS. 3*b*, 3*c* illustrate the process of doubling over the adjustable headrest with the elongated tab wrapping around and holding the headrest in position to serve as an independent neck support and headrest. The adjustable nature of the series of Velcro strips 18 on the elongated tab 14 permits for varying degrees of tightness in the doubled over neck rest." The Cupo invention also allows for varying degrees of firmness but does not require going through the U shaped cut out. The Cupo invention uses a pillowcase for adjusting firmness of the interior pillow. The pillowcase front, which is a few inches longer than the pillowcase back along the opening side, creates a flap used for closure. The flap, having a strip of Velcro hook on the underside of it, is brought around to the back side of the pillowcase for fastening to one of the several strips of Velcro hoop attached to the back side of the pillowcase, without going through the U shape cut out. The Velcro loop is disposed along the top outside edge of the back opening with additional parallel strips of Velcro loop several inches below it.

In the Camelio invention (neck rest configuration), doubling over the adjustable headrest is accomplished by taking the flap through the U shape. The material directly behind the head is compressed, adjusting for firmness behind the neck only. In the Cupo invention, securing the flap to the back side of the pillow adjusts the firmness throughout the pillow, the body of the pillow and the arms of the pillow.

Two constructions are described in Camelio, neither construction has a U-shaped offset cutout.

In accordance with the present invention, there is provided a multipurpose, ergonomic, adjustable pillow that is functional (can be used in a variety of sleeping and resting positions, both supine and upright), portable, and also decorative. The pillow also has a contoured pillowcase that complements a corresponding pillow insert. The decorative contoured pillowcase has hook and loop fastener (VELCRO® closure that can be adjusted to vary the pillow's firmness and thickness. The pillow insert has a U-shaped offset cutout along one side which can be rotated to accommodate a variety of sleeping and resting positions, both supine and upright.

The pillowcase is removable and washable.

The pillowcase front is a few inches longer than the pillowcase back along the opening side, creating a flap used for closure. A strip of Velcro® hook is disposed along the underside of the front flap. A corresponding strip of Velcro® loop is disposed along the top outside edge of the back opening with additional parallel strips of Velcro® loop several inches below it.

For side and stomach sleepers, the cutout is positioned outwardly to the side (left or right depending on the side the user is currently sleeping on). The soft arms created by the cutout support the head and neck while the face remains suspended thereover. The offset cutout serves a variety of purposes: it helps relieve facial pressure following plastic surgery and creates an open air passageway for easier breathing. The offset cutout allows for dual positioning. Users with broader shoulders or longer necks may prefer to place the wider arm under their neck. The hook-and-loop closure is used to adjust for pillow firmness (thickness).

For back sleepers and those in an upright or reclining position, the cutout is positioned downwardly to conform to the shape of the neck and the pillow supports both neck and head. The soft "arms" created by the cutout then come around and support the neck while the body of the pillow supports the head.

The pillow insert is substantially rectangular in shape with a U-shaped offset cutout along one side. The offset cutout can be rotated to accommodate a variety of sleeping and resting positions, both supine and upright.

Considering the foregoing, it is a primary object of the present invention to provide a pillow that is versatile, adjustable, portable, decorative, and can be used comfortably in a variety of sleeping and resting positions.

It is an object of the invention to provide a pillow that provides maximum comfort for those in a variety of sleeping positions (back, side, stomach).

It is another object of the invention to provide a pillow that can be used in reclining/upright positions to support both the head and the neck while reading, resting, or sleeping.

It is yet another object of the invention to provide a pillow with adjustable loft and pillow firmness.

It is a further object of the invention to provide a pillow that is compact, portable, and ideal for travel, used while sitting in a typical airline seat, and fitting neatly in a small carry-on bag.

It is an object of the invention to provide a pillow with unequally sized arms to accommodate side and stomach sleepers with varying neck and shoulder size.

It is an object of the invention to provide a pillow that keeps nasal passageways open for easier breathing.

It is an object of the invention to provide a pillow that enhances comfort following facial plastic surgery.

It is an object of the invention to provide a pillow with an outer contoured pillowcase that is removable and easily washable.

It is an object of the invention to provide a pillow with an outer contoured pillowcase that is decorative as well as functional, making it aesthetically suitable for bedroom, family room, or living room.

It is an object of the invention to provide comfort to side and stomach sleepers who can rotate the pillow cutout to the side. The soft arms created by the cutout supports the head and neck while the face remains suspended over the cutout.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
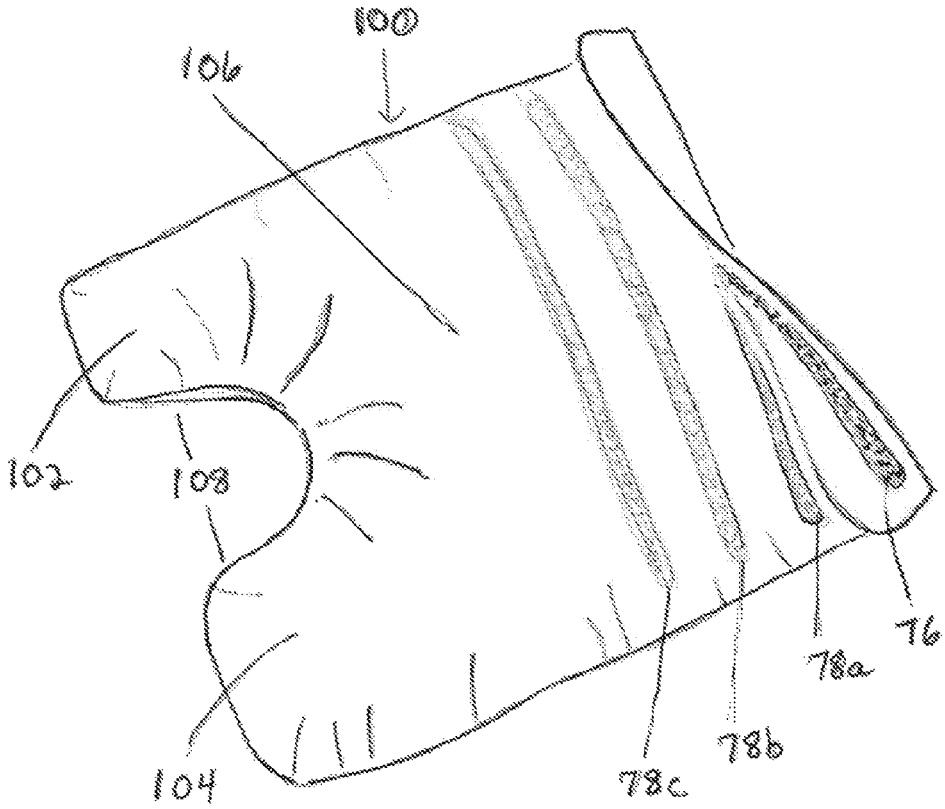
FIG. 1 is a perspective view of the contoured pillowcase in accordance with the present invention with pillow inserted and contoured pillowcase slightly open.

A perspective view of the multipurpose ergonomic adjustable pillow of the invention is shown in FIG. 1 and is generally indicated as reference numeral 100. The multipurpose adjustable pillow 100 is made of a contoured pillow case 60 and corresponding pillow insert 40. The contoured pillowcase 60 is slightly open to demonstrate hook and loop (i.e., VELCRO® fastener comprising hooks 76 and loops 78.

Figure 2:
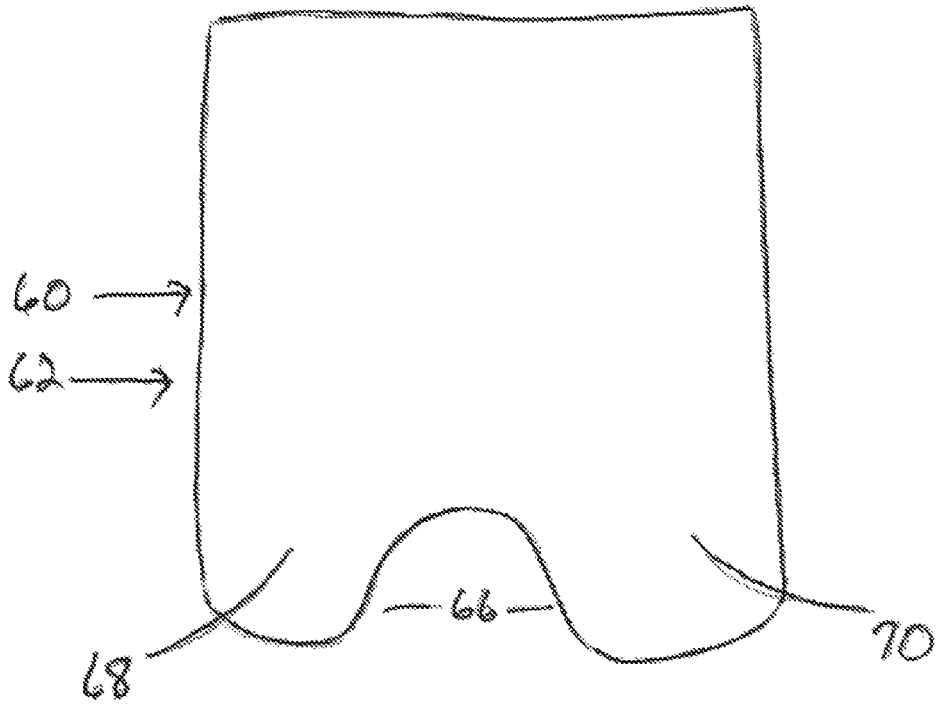
FIG. 2 is a top view of the front of the contoured pillow case.
Figure 3:
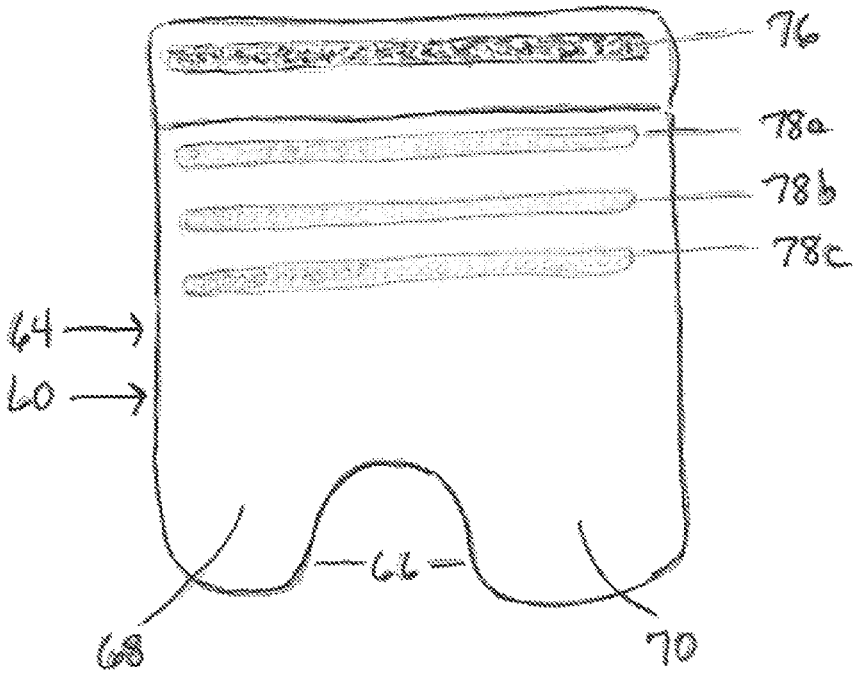
FIG. 3 is a top view of the back of the contoured pillowcase.

FIGS. 2 and 3 are views of the contoured pillowcase 60, with FIG. 2 illustrating the top view of the front of contoured pillowcase 62 and FIG. 3 illustrating the top view of the back of contoured pillowcase 64.

The contoured pillowcase 60 is generally rectangular in shape with a U-shaped offset cutout 66 along one edge thereof. The U-shaped cutout 66 creates a narrow arm 68 and a wider arm 70. Optionally, the length of arms 68 and 70 may not be equal. The contoured pillowcase front 62 and back 64 are sewn together along three sides. The fourth side, opposite the side with cutout 66, is left open for insertion/removal of pillow 40.

The contoured pillowcase front 62 is a few inches longer than the contoured pillowcase back 64 along the opening side, creating a front flap 74 used for closure. A strip of hooks 76 is disposed along the underside of the flap 74. A corresponding strip of loops 78*a* is placed along the top outside edge of the back opening; additional strips of loops 78*b*, 78*c* are configured in parallel relationship several inches below strip 78*a*. The strips of hooks and loops 76, 78*a*-78*c* are all approximately equal in length corresponding to the width of the pillowcase 60.

Pillow case 60 is closed by pulling front flap 74 over the back of pillowcase 64 and attaching the hooks 76 on the underside of front flap 74 to one of corresponding strips of loops, 78*a*, 78*b*, or 78*c* on the back of pillowcase 64. The adjustable pillowcase 60 is necessary to adjust for pillow firmness. The farther over the front flap 74 is pulled, the firmer the pillow 40.

Hooks 76 and loops 78*a*-78*c* can be any one of a variety of hook and loop products on the market. Contoured pillowcase 60 can be made of a variety of materials, including but not limited to cotton, satin, flannel, polyester, or vinyl. Water-resistant fabrics can be used for camping and outdoor use. Pillow insert 40 can be filled with an array of soft lose fill including polyester fill, down, down alternative, wool, etc.

Figure 4:
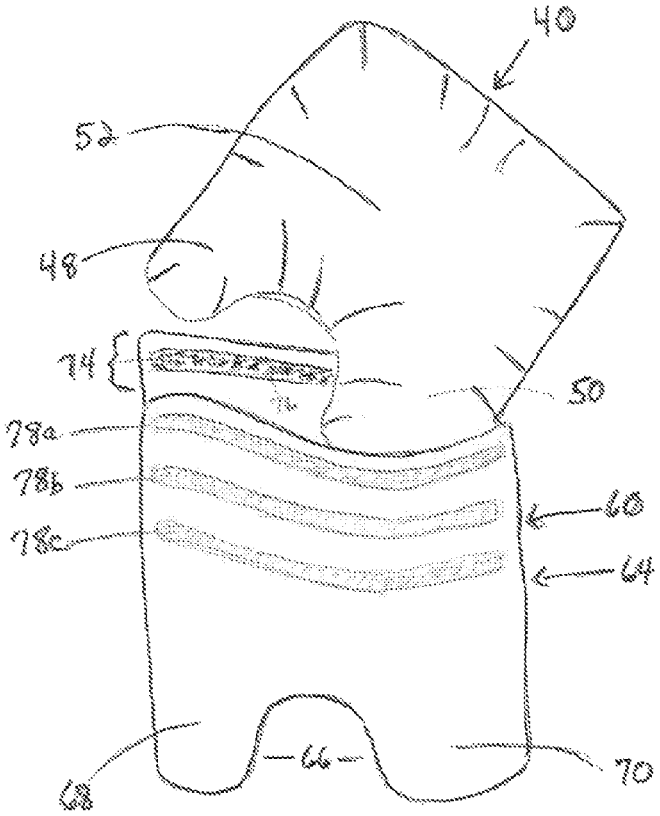
FIG. 4 is a top view of the back of the contoured pillowcase with the pillow partially inserted in the case.
Figure 5:
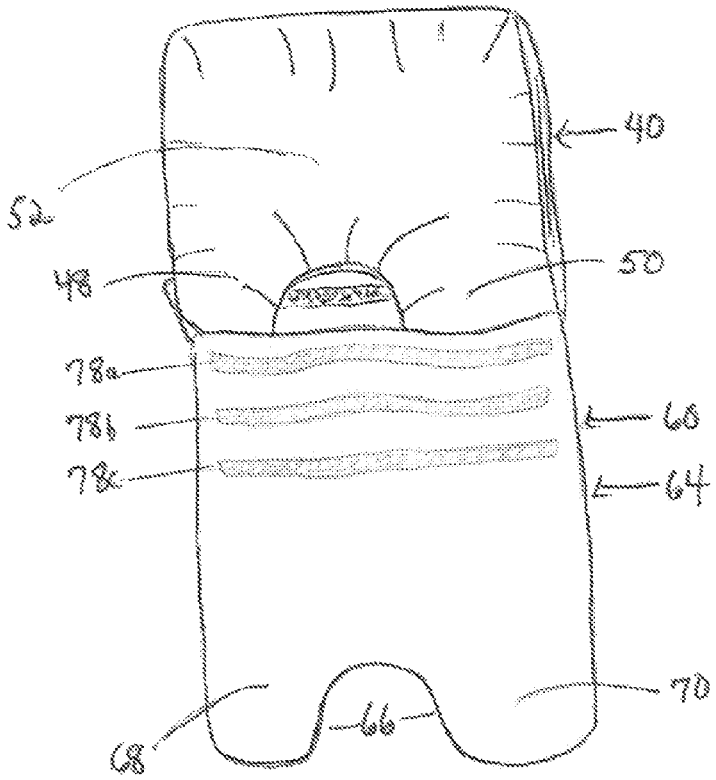
FIG. 5 is a top view of the back of the contoured pillowcase with the pillow further inserted in the case.

FIGS. 4 and 5 illustrate the contoured pillowcase 60 with the pillow 40 partially inserted therein. FIG. 4 is a top view of contoured pillowcase back 64 with pillow 40 partially inserted in case 60. FIG. 5 is a top view of contoured pillowcase back 64 with pillow 40 further inserted in case 60. Pillow 40 is inserted so that the narrow arm 48 of pillow 40 is inserted in corresponding narrow arm 68 of pillowcase 60.

Figure 6:
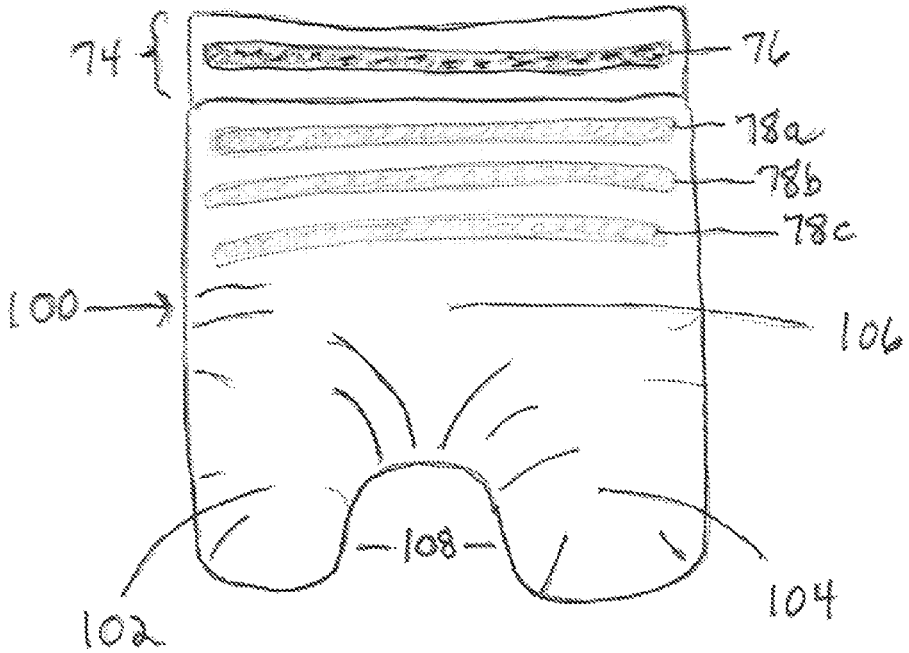
FIG. 6 is a top view of the back of the contoured pillowcase with the pillow fully inserted in the case.
Figure 7:
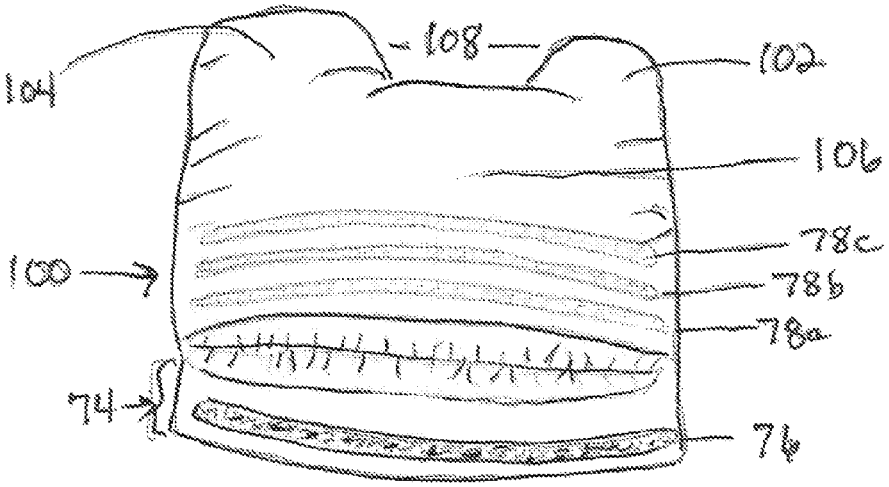
FIG. 7 is a perspective view of the back of the contoured pillowcase with the pillow fully inserted in the case.

FIGS. 6 and 7 illustrate the pillowcase 60 with pillow 40 fully inserted therein and flap 64 thereof remaining open. FIG. 6 is a top view of pillow case back 64 with pillow 40 fully inserted in the case 60. FIG. 7 is a perspective view of pillowcase back 64 with pillow 40 fully inserted therein.

Figure 8:
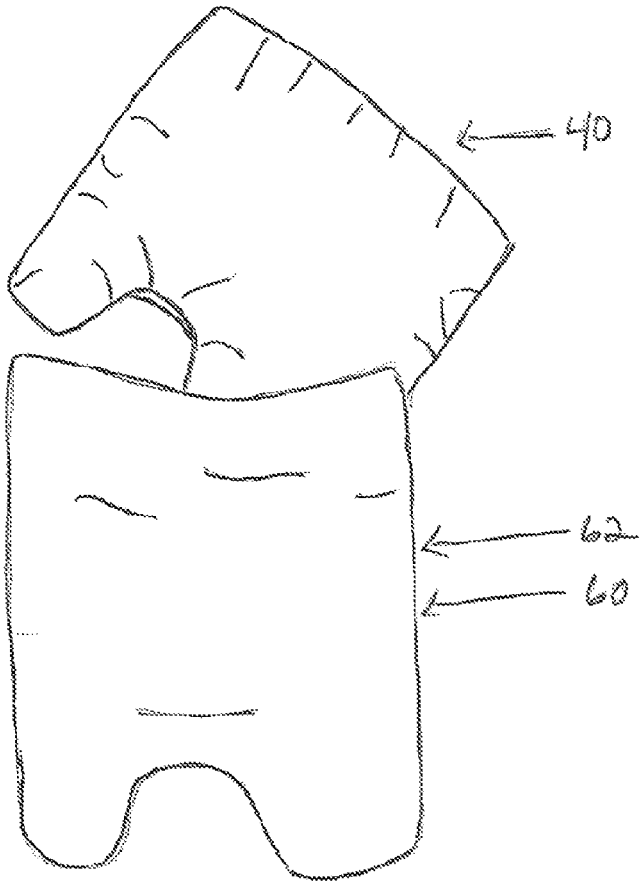
FIG. 8 is a top view of the front of the contoured pillowcase with pillow partially inserted in the case.
Figure 9:
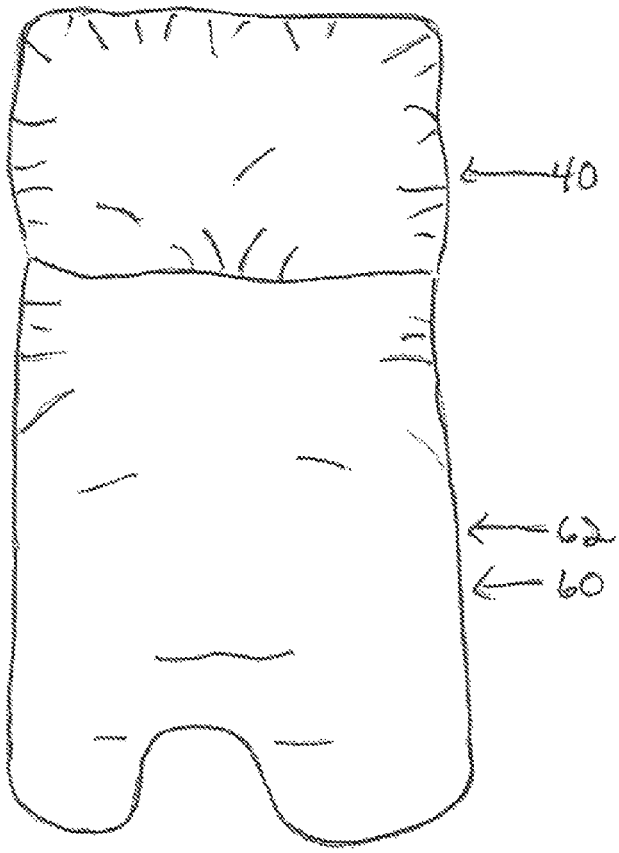
FIG. 9 is a top view of the front of the contoured pillowcase with the pillow further inserted in the case.

FIGS. 8 and 9 illustrate pillowcase 60 with pillow 40 partially inserted therein. FIG. 8 is a top view of pillowcase front 62 with pillow 40 partially inserted, and FIG. 9 is a top view of pillowcase front 62 with pillow 40 further inserted therein.

FIGS. 10 through 15 illustrate pillowcase 60 with pillow 40 fully inserted therein and flap 74 attached successively to one of several strips of hook and loop fasteners 78*a*, 78*b*, 78*c*, respectively, on the back 64 of pillowcase 60.

Figure 10:
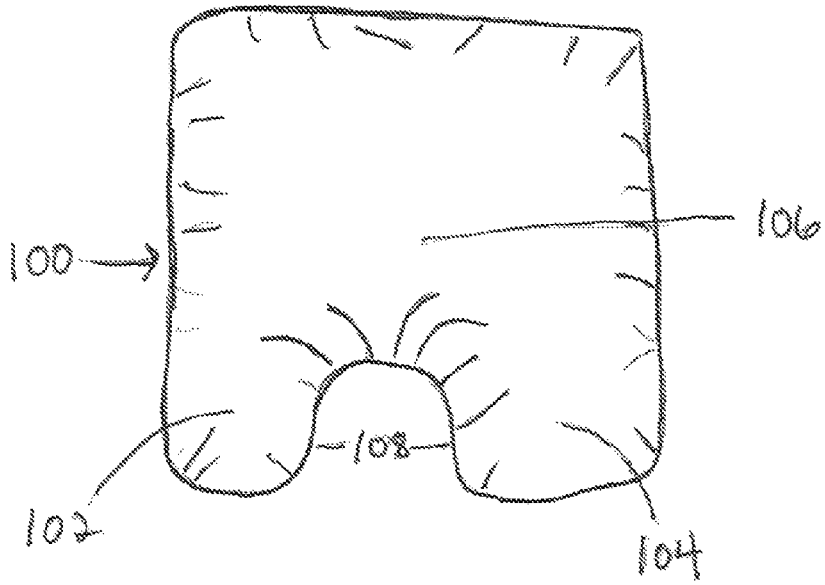
FIG. 10 is a top view of the front of the contoured pillowcase with the pillow inserted and the front flap closed.

FIG. 10 is a top view of pillowcase front 62 with pillow 40 fully inserted therein and front flap 74 closed over the first strip of loops 78*a*.

Figure 11:
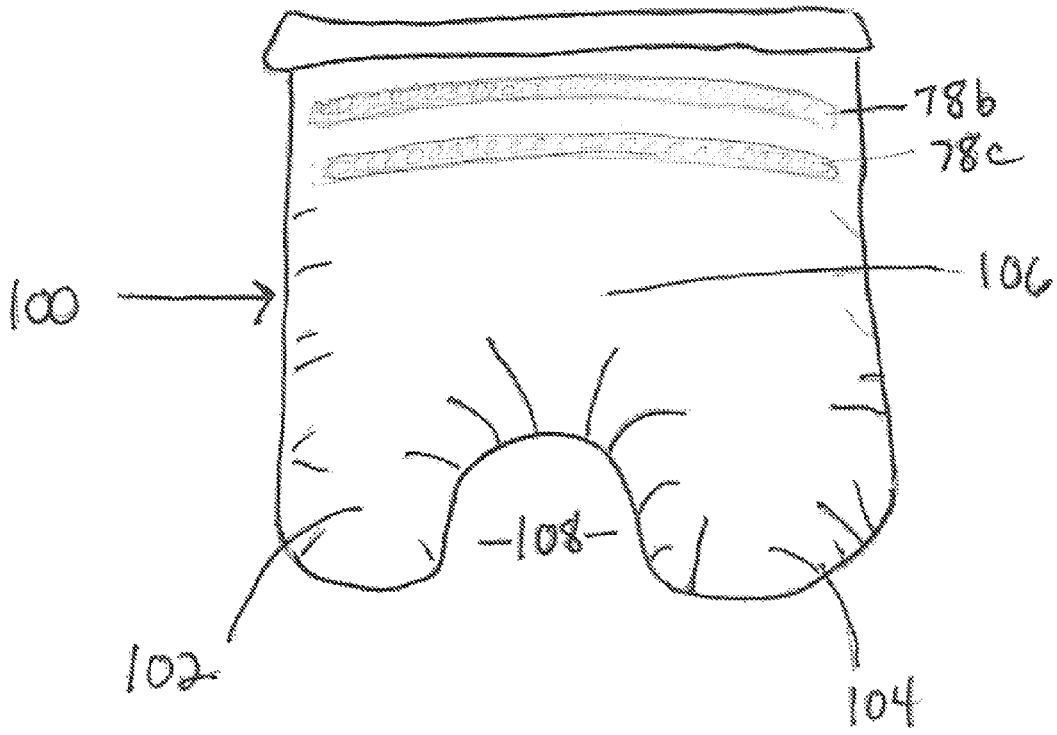
FIG. 11 is a top view of the back of the contoured pillowcase with the pillow inserted and the front flap closed.

FIG. 11 is a top view of pillowcase back 64 with pillow 40 fully inserted therein and front flap 74 closed over loop strip 78*a*.

Figure 12:
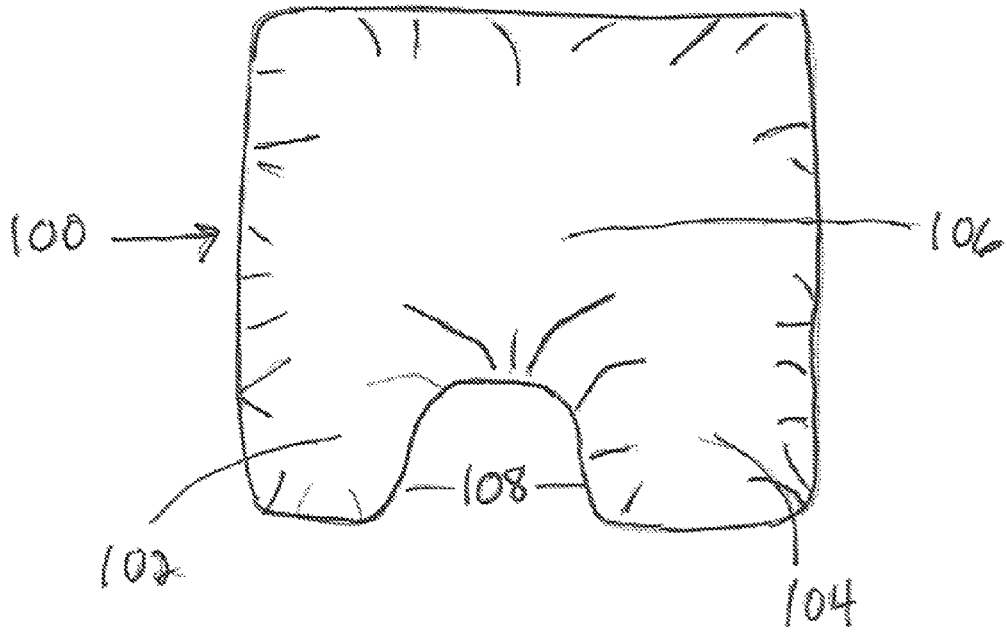
FIG. 12 is a top view of the front of the contoured pillowcase with the pillow inserted and the front flap closed.

FIG. 12 is a top view of pillowcase front 62 with pillow 40 fully inserted therein and front flap 74 closed over adjacent loop strip 78*b*.

Figure 13:
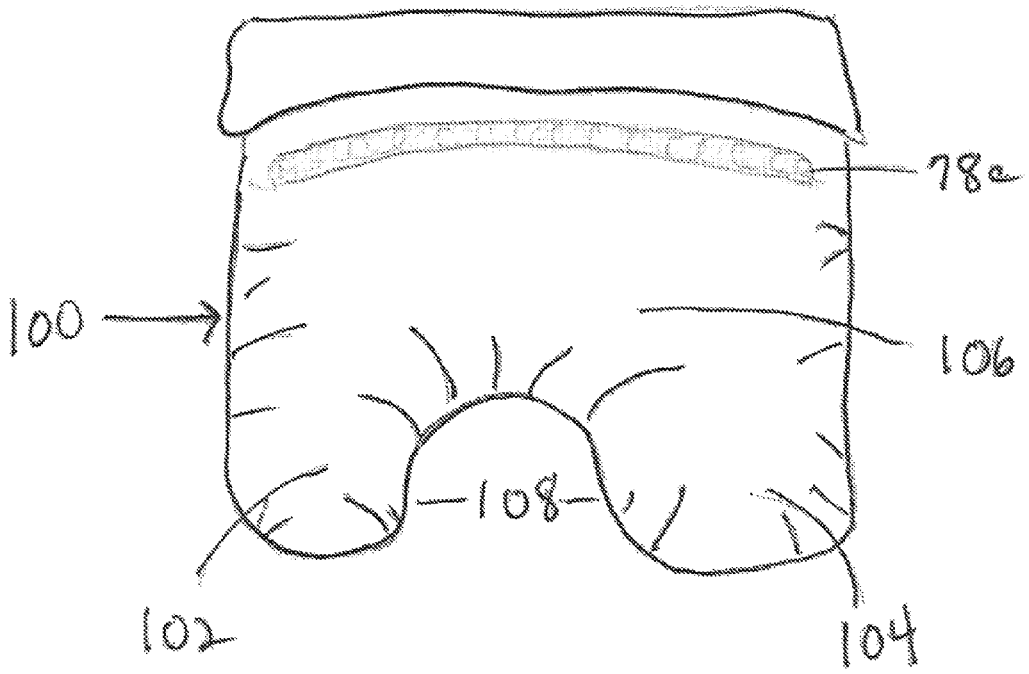
FIG. 13 is a top view of the back of the contoured pillowcase with the pillow inserted and the front flap closed.

FIG. 13 is a top view of pillowcase back 64 with pillow 40 fully inserted therein and front flap 74 closed over adjacent loop strip 78*b*.

Figure 14:
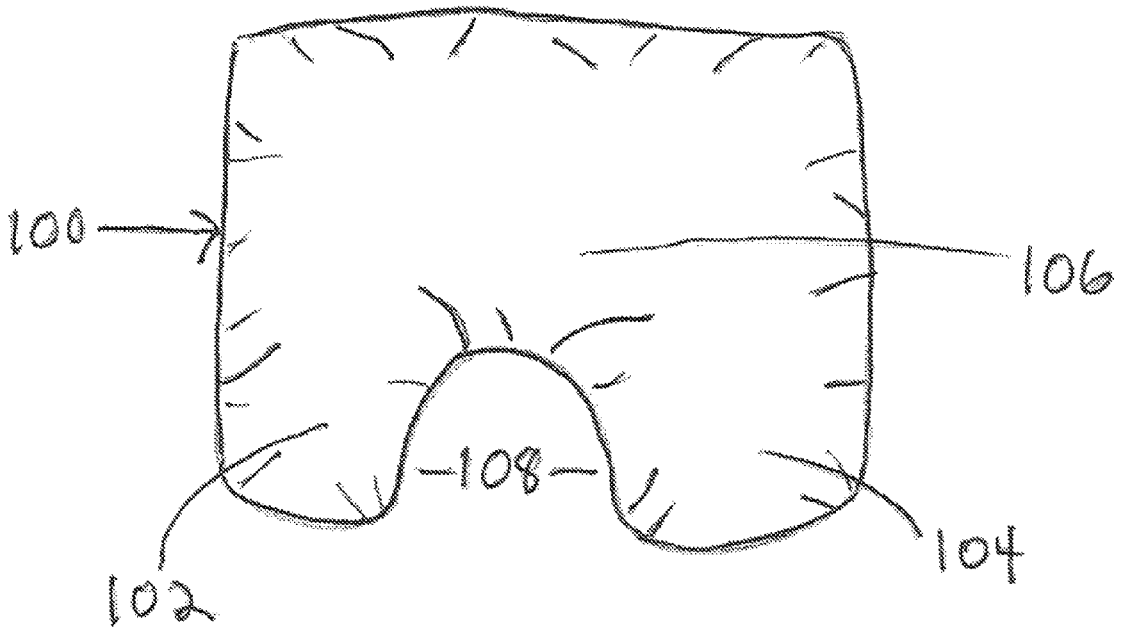
FIG. 14 is a top view of the front of the contoured pillowcase with the pillow inserted and the front flap closed.

FIG. 14 is a top view of pillowcase front 62 with pillow 40 fully inserted therein and front flap 74 closed over adjacent loop strips 78*c*.

Figure 15:
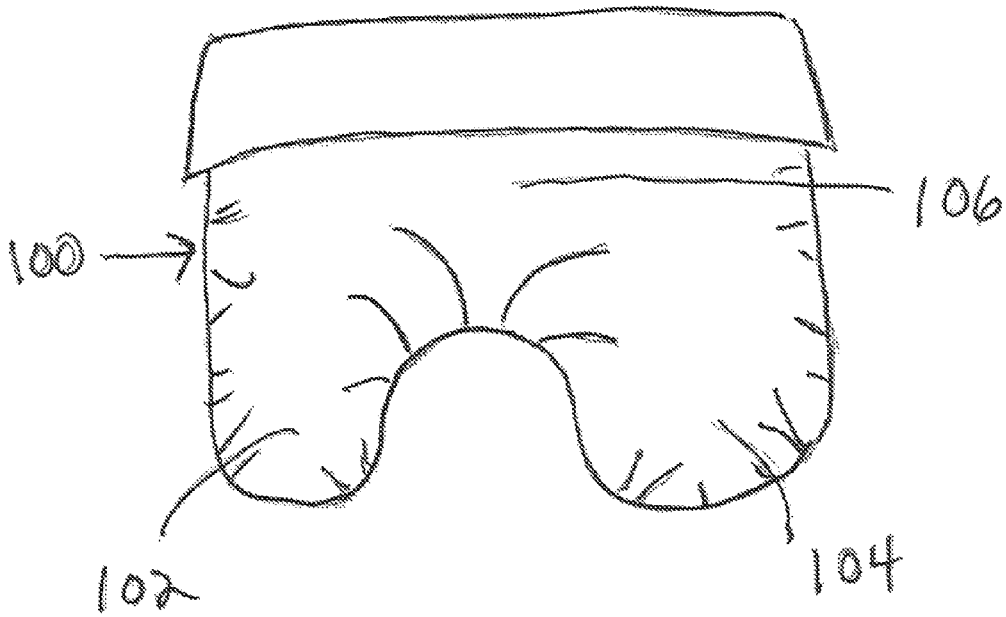
FIG. 15 is a top view of the back of the contoured pillowcase with pillow inserted and front flap closed.

FIG. 15 is a top view of the contoured pillowcase back 64 with pillow 40 fully inserted therein and front flap 74 closed over adjacent loop strip 78*c*.

While three parallel Velcro® loop strips 78*a*, 78*b*, 78*c* are illustrated, it should be understood that additional or fewer parallel strips of loop fasteners can be used and, in fact can be replaced with intermittent strip portions, not shown, or circular or polygonal shapes.

Figure 16:
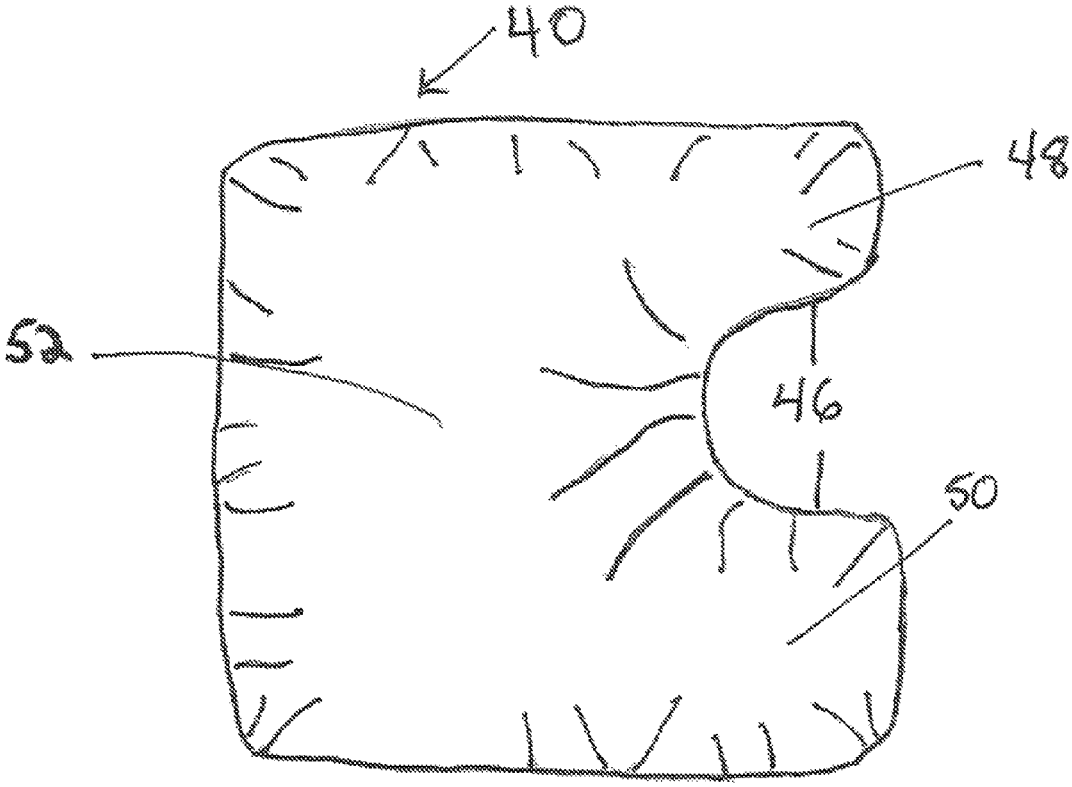
FIG. 16 is a top view of the pillow in accordance with the present design.

FIG. 16 is a top view of pillow 40 with a U-shaped offset cutout 46, which creates narrow arm 48 and wide arm 50. Pillow 40 is rectangular in shape, and can be filled with an array of soft loose fill, including down, down alternative, poly-fill, loose wool, etc. Pillow thickness is substantially uniform from arms 48 and 50 to the center 52 of pillow 40.

Figure 17:
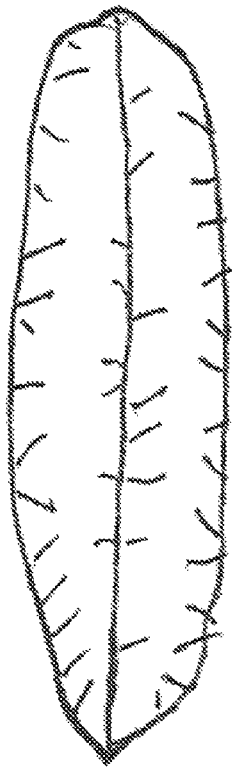
FIG. 17 is a left side view of the pillow of FIG. 16.
Figure 18:
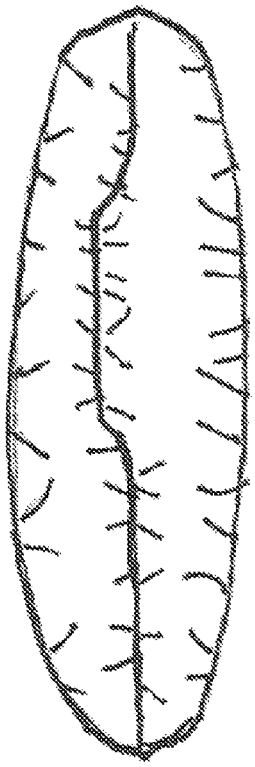
FIG. 18 is a right end view of the pillow of FIG. 16.
Figure 19:
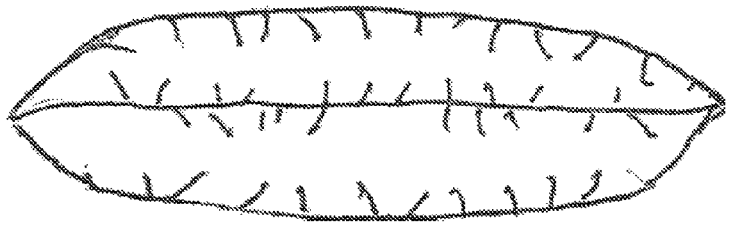
FIG. 19 is a front side view of the pillow of FIG. 16.
Figure 20:
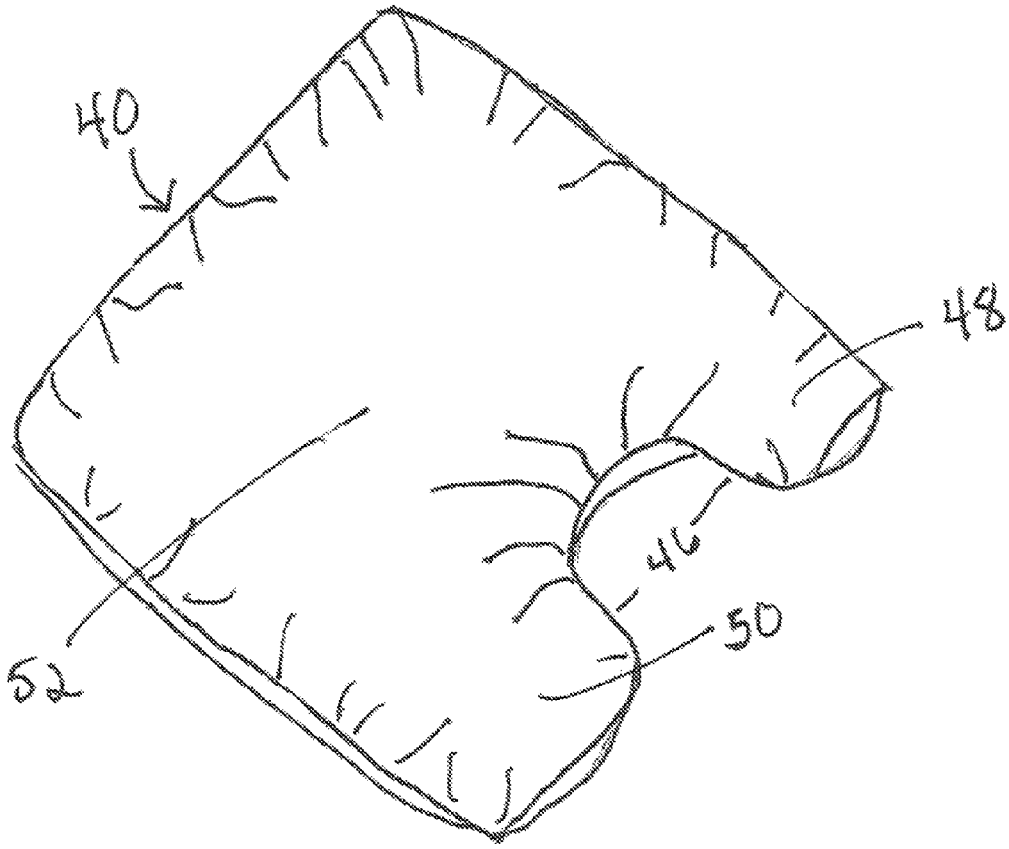
FIG. 20 is a perspective view of the pillow in FIG. 16.

FIGS. 17 through 20 are additional views of pillow 40. FIG. 17 is a left side view thereof; FIG. 18 is a right end view thereof; and FIG. 19 is a front side view thereof. FIG. 20 is a perspective view of pillow 40 shown in FIG. 16.

Figure 21:
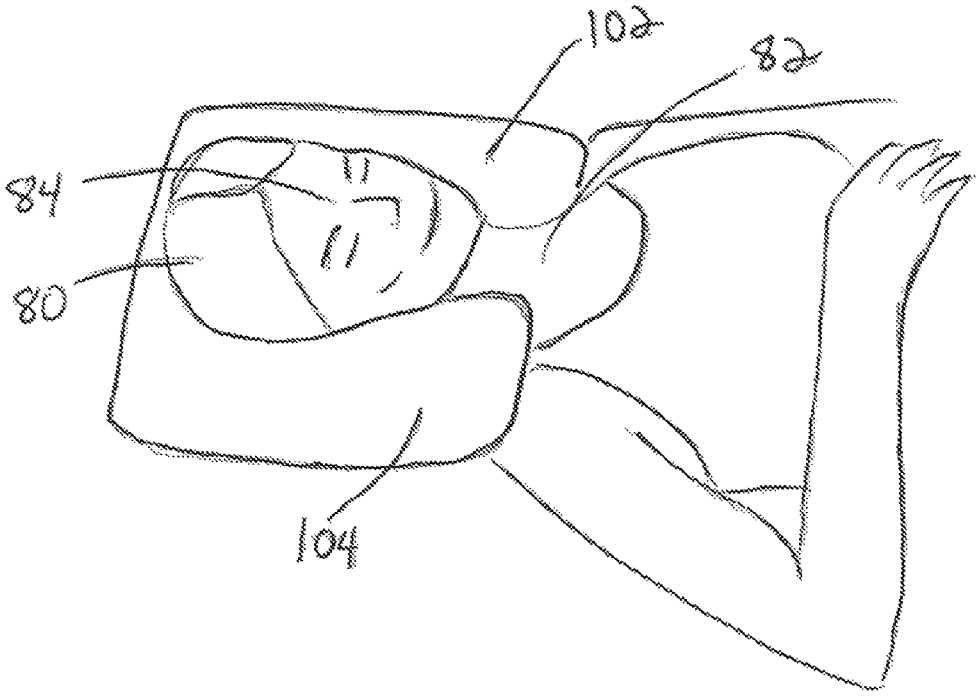
FIG. 21 shows a first preferred embodiment use of the pillow and case, with a person lying on her back and the offset cutout around her neck.

FIGS. 21 through 24 illustrate some of the many uses for the multipurpose, ergonomic, adjustable pillow 100. FIG. 21 shows a user 80 in a supine position on his or her back. The body of pillow 106 supports the user's head 80 while arms 102, 104 support the user's neck 82. The multipurpose pillow 100 can be adjusted for firmness by adjusting the front flap 74 of pillowcase 60.

Figure 22:
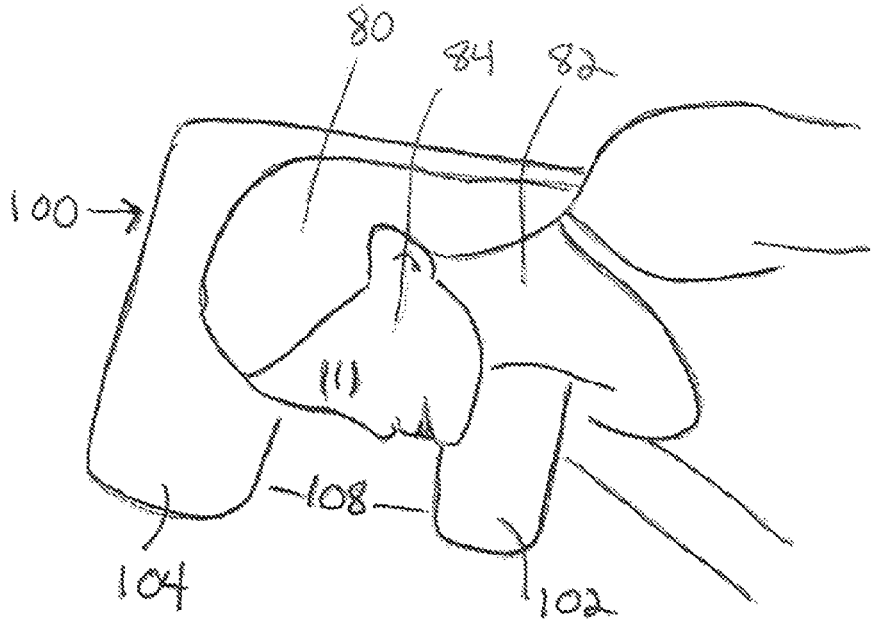
FIG. 22 shows a second embodiment use of the pillow and case, with a person lying on her side, her face suspended and her air passage free.

FIG. 22 shows the user 80 in a supine position on his/her right side. The head 80 and neck 82 are supported by arms 102, 104 of pillow 100. The user's face 84 is suspended over cutout 108 to reduce facial pressure and improve breathing. Pillow 100 can be flipped sideways with cutout 108 facing the opposite direction, so that the user can maintain an identical position on his/her left side. In addition, pillow 100 can be flipped or rotated vertically so that wider arm 104 is under the user's chin, supporting the user's neck 82. The multipurpose pillow 100 can be adjusted for firmness by adjusting front flap 74 of pillowcase 60.

Figure 23:
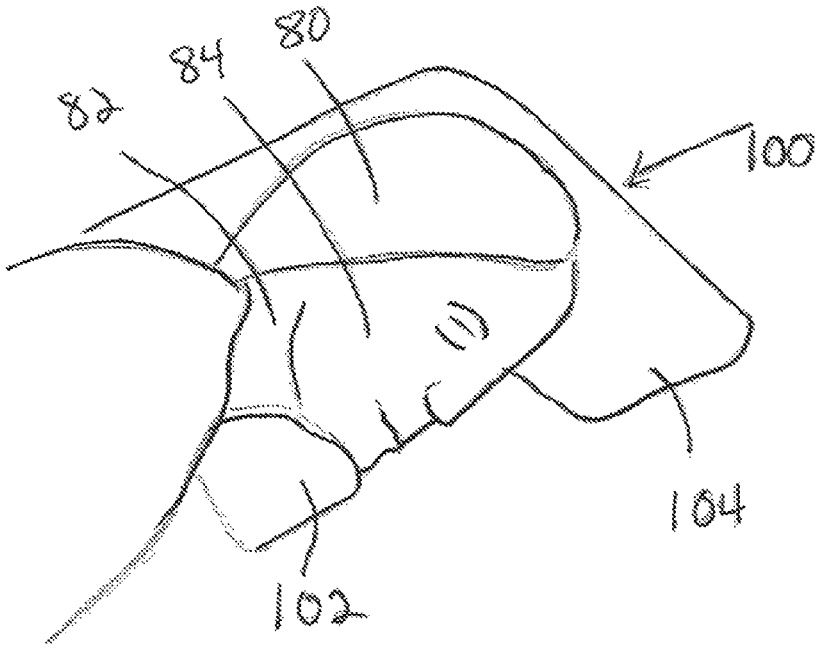
FIG. 23 shows a third embodiment use of the pillow and case, with a person lying prone and her air passage free.

FIG. 23 shows the user in a supine position on his/her stomach. The user's head 80 and neck 82 are supported by arms 102, 104 of pillow 100. The user's face 84 is suspended over cutout 108 to create a clear passageway for breathing. The pillow 40 can be flipped sideways with cutout 108 facing the opposite direction, so that the user can maintain an identical position on his/her stomach, turned to the right. In addition, the pillow 100 can be flipped or rotated vertically so that wider arm 104 is under the user's chin, supporting user's neck 82. Note that pillow 100 can be adjusted for firmness by adjusting front flap 74 of pillowcase 60.

Figure 24:
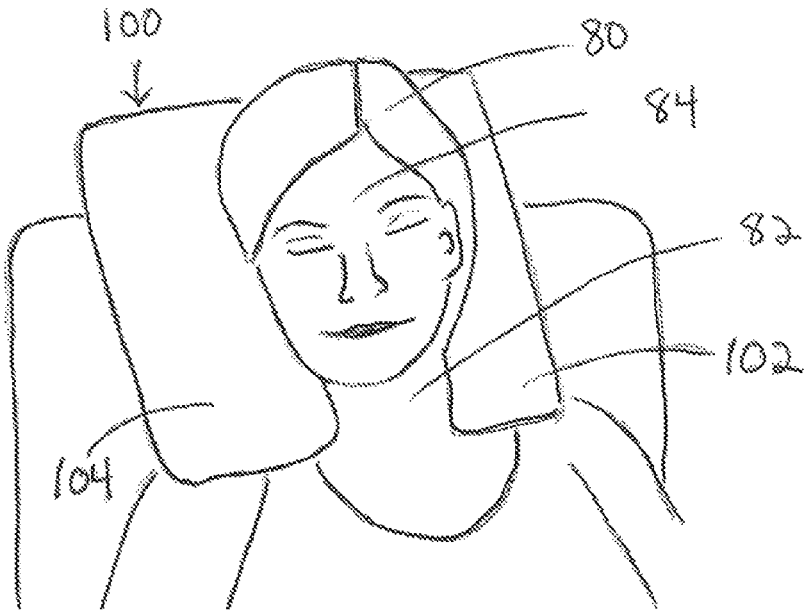
FIG. 24 shows a fourth embodiment use of the pillow and case, with a person sitting upright, the offset cutout around his neck.

FIG. 24 shows the user in an upright, slightly reclining position. The user's head 80 is supported by the body 106 of pillow 100. The user's neck 82 is supported by arms 102, 104. Note that pillow 100 can be used in both a reclining and upright position. The ergonomic pillow 100 is suitable for resting, reading, watching TV, etc. Pillow 100 can be adjusted for firmness by adjusting front flap 74 of pillowcase 60.

Since other modifications are changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by Letters Patent is presented in the subsequently appended claims.

What is claimed is:

1. A multipurpose, ergonomic, adjustable pillow comprising a generally rectilinear pillow body having three substantially straight edges and a fourth edge having a midpoint and a U-shaped cutout with a curvilinear portion at the upper extremity thereof offset from said fourth edge midpoint, creating two arms of unequal width;

wherein a first straight continuous edge is opposite the edge with U-shaped cutout, the second straight continuous edge extends continuously from the first straight continuous edge to the edge with U-shaped cutout, the third continuous straight edge extends continuously from the first straight continuous edge to the edge with U-shaped cutout and is opposite the second continuous straight edge, wherein the three continuously straight edges and the fourth edge with the U-shaped cutout form the outer perimeter of the pillow.

2. The multipurpose, ergonomic adjustable pillow in accordance with claim 1, further comprising a removable contoured pillowcase for covering said pillow, said pillowcase comprising means for adjusting firmness of said pillow.

3. The multipurpose ergonomic adjustable pillow in accordance with claim 2, wherein said means for adjusting firmness comprises a flap along the top, open edge of the pillowcase that can be secured to one of several attachments on the back side of said pillowcase without going through the U shaped cutout.

4. The multipurpose ergonomic adjustable pillow in accordance with claim 3, wherein said means for adjusting firmness comprises a flap along the top, open edge of the pillowcase, said flap containing a strip of hooks on the underside edge secured to one of several attachments on the back side of said pillowcase, thus varying the volume in the pillow and pillowcase and creating different levels of firmness throughout the body and the arms of the pillow.

5. The multipurpose ergonomic adjustable pillow in accordance with claim 4, wherein said several attachments are loops, said loops are configured in at least two positions on the back of the pillowcase for creating different levels of firmness.

* * * * *